US008430397B2

(12) United States Patent
Horiuchi et al.

(10) Patent No.: US 8,430,397 B2
(45) Date of Patent: Apr. 30, 2013

(54) SHEET TAKE-OUT DEVICE

(75) Inventors: Haruhiko Horiuchi, Kanagawa-ken (JP); Takashi Hirayama, Kanagawa-ken (JP)

(73) Assignee: Toshiba Corporation, Tokyo (JP)

( * ) Notice: Subject to any disclaimer, the term of this patent is extended or adjusted under 35 U.S.C. 154(b) by 0 days.

(21) Appl. No.: 13/415,330

(22) Filed: Mar. 8, 2012

(65) Prior Publication Data

US 2013/0038015 A1 Feb. 14, 2013

(30) Foreign Application Priority Data

Mar. 11, 2011 (JP) ..... 2011-054760

(51) Int. Cl.
*B65H 1/02* (2006.01)

(52) U.S. Cl.
USPC ..... 271/150; 271/31.1

(58) Field of Classification Search ..... 271/3.12, 271/31.1, 149–155
See application file for complete search history.

(56) References Cited

U.S. PATENT DOCUMENTS 4,884,797 A * 12/1989 Svyatsky ..... 271/126
5,022,643 A * 6/1991 Crawford et al. ..... 271/267
5,297,785 A * 3/1994 Ricciardi ..... 271/3.18
7,815,184 B2 * 10/2010 Watanabe et al. ..... 271/104
8,342,512 B2 * 1/2013 Watanabe et al. ..... 271/152
2007/0176353 A1 * 8/2007 Steinhuebel ..... 271/150

FOREIGN PATENT DOCUMENTS

JP 2007-326713 12/2007
JP 2012180206 A * 9/2012

* cited by examiner

*Primary Examiner* — Jeremy R Severson
(74) *Attorney, Agent, or Firm* — Baker Botts L.L.P.

(57) ABSTRACT

A sheet take-out device in which sheets are conveyed in an upright state and sheets having a low height can be stably taken out is provided.

A sheet take-out device includes a main floor belt that conveys sheets that are placed in an upright state in a direction intersecting a conveying direction to a take-out portion, and a take-out unit that takes out the sheets conveyed by the main floor belt one by one in order from the frontmost sheet. The device includes a sub-floor belt that is capable of reverse conveyance, in which sheets are conveyed in a direction opposite to the conveying direction of the main floor belt, a tightness detection unit, and a height detection unit that detects the height of the sheets immediately prior to being taking out by the take-out unit, and performs sub-floor control.

5 Claims, 5 Drawing Sheets

SHEET TAKE-OUT DEVICE

CROSS-REFERENCE TO RELATED APPLICATION

This application is based upon and claims the benefit of priority from the prior Japanese Patent Application No. 2011-054760 filed Mar. 11, 2011, the entire contents of which are incorporated herein by reference.

TECHNICAL FIELD

Exemplary embodiments of the disclosure described herein relate to a sheet take-out device.

BACKGROUND ART

Sheet reading and sorting machines for sorting such as postal items read the postal code and the address indicated on deliveries as the sorting destination with a scanner, and recognize the read image data by OCR (with a recognition unit), for example. The sheet reading and sorting machines perform a sorting process of sorting to the sorting destinations based on the result of this recognition. These sheet reading and sorting machines include a sheet take-out device for taking out sheets.

The take-out performance of this sheet take-out device depends largely on the size, in the conveying direction, of the handled sheets. There is a problem in that if sheets whose length in the conveying direction is short are handled, the conveying pitch is long relative to the sheets, so that the processing efficiency is reduced accordingly. In order to solve this problem, a method is known in which when sheets have the same length in the conveying direction, that length in the conveying direction is measured, and the take-out speed is changed according to the length of the sheets so as to adjust the gap between the sheets, thereby improving the sheet processing efficiency (e.g., see Patent Document 1).

Also, there is a problem in that errors such as overlapped feeding, a failure in taking out sheets, and the like occur if sheets are supplied to a take-out unit in a tight state. In order to solve this problem, in conventional techniques, the floor belt on which sheets are placed is rotated in reverse for a predetermined period of time, such that the sheets are separated away from the take-out unit in a poor take-out state so as to be put in a loose state.

RELATED ART DOCUMENTS

Patent Documents

Patent Document 1: JP H6-71943B (page 2 and FIG. 2)

SUMMARY

The invention disclosed in Patent Document 1 has the problem that it is difficult to expect an improvement in the reduction of the processing efficiency due to failures in properly taking out sheets when the sheets have different heights.

Also, the heights of the supplied sheets are not constant. Thus, if the floor belt is rotated in reverse for a predetermined period of time, since the amount of reverse rotation is constant, if sheets having a low height have been supplied in succession, the sheets may tilt too much.

The present disclosure has been achieved in order to solve the above-described problems, and it is an object of the present disclosure to provide a sheet take-out device that can improve a reduction in the processing efficiency due to failure in properly taking out sheets having a low height (low sheets), by controlling a reverse rotation amount of a sub-floor belt according to the degree of tightness and the height information of sheets supplied to a take-out unit.

Means for Solving the Problems

To attain this object, a sheet take-out device according to a first aspect of the present disclosure includes: a main floor belt that conveys sheets that are placed in an upright state in a direction intersecting a conveying direction to a take-out portion; a take-out unit that takes out the sheets conveyed by the main floor belt one by one in order from the frontmost sheet; and a conveyance unit that conveys the sheets taken out by the take-out unit, wherein a failure in properly taking out sheets is improved by including: a sub-floor belt that is disposed at a location on the same plane as a conveyance face of the main floor belt and opposing a leading end in the conveying direction of the main floor belt, and that is capable of reverse conveyance, in which sheets are conveyed in a direction opposite to the conveying direction of the main floor belt; a tightness detection unit that detects the tightness of the sheets immediately prior to being taken out by the take-out unit; a height detection unit that detects the height of the sheets immediately prior to being taking out by the take-out unit; and a sub-floor control unit that sets a time for the reverse conveyance performed by the sub-floor belt according to a result of detection performed by the tightness detection unit and the sheet height obtained by the height detection unit.

EMBODIMENTS

A sheet take-out device according to Embodiment 1 of the present disclosure is constituted by a rotary valve, a take-out belt, a take-in roller, a reverse roller, a main floor belt, a sub-floor belt, a tightness detection sensor, a height detection sensor, and a control device for controlling these. It is possible to improve the above-described failure in properly taking out sheets by performing control so as to rotate the sub-floor belt in reverse based on information from the tightness detection sensor and the height detection sensor.

The configuration and operation of these will be described with reference to the drawings.

Embodiment 1

Figure 1:
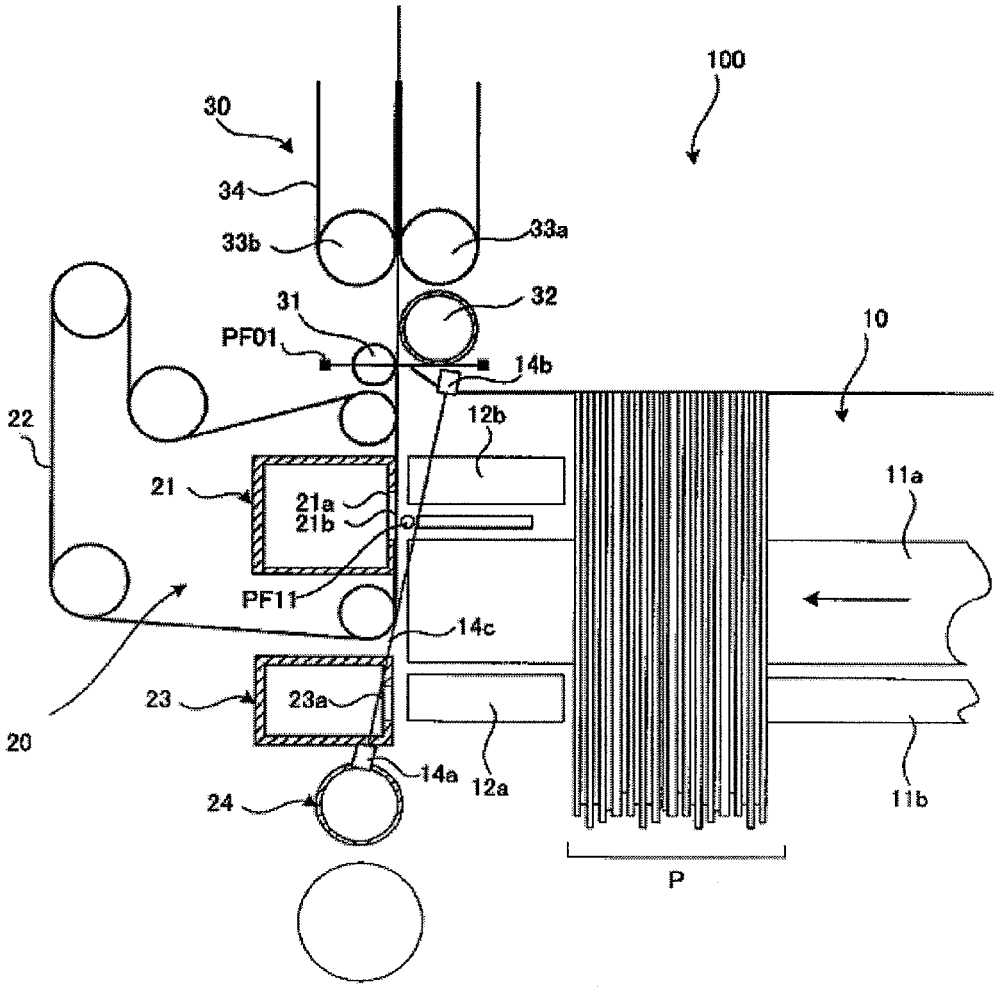
FIG. 1 is a diagrammatic plan view of a sheet take-out device according to Embodiment 1 of the present disclosure.

FIG. 1 is a diagrammatic plan view of a sheet take-out device 100 according to Embodiment 1 of the present disclosure. The sheet take-out device 100 is constituted by a supply unit 10, a take-out unit 20 and a conveyance unit 30.

The supply unit 10 is constituted by a main floor belt 11 (this collectively refers to floor belts 11*a* and 11*b*), a sub-floor belt 12 (this collectively refers to sub-floor belts 12*a* and 12*b*) disposed at a position opposing the main floor belt 11, a rear floor belt (not shown in the drawings), a tightness detection sensor PF 11, and a height detection sensor 14 (this collectively refers to a light projector 14*a* and a light receiver 14*b*), for example. The main floor belt 11, the sub-floor belt 12 and the rear floor belt are controlled by a drive motor (not shown in the drawings) and a controller that controls the drive motor.

The tightness detection sensor PF 11 detects whether the sheets placed on the main floor belt 11 and the sub-floor belt 12 in an upright state are in a loose state or a tight state. The tightness detection sensor PF 11 employed in Embodiment 1 is configured by a line sensor that is disposed in the conveying direction (placement direction) of sheets and that receives reflected light. The tightness of sheets is determined by integrating a signal output from the tightness detection sensor PF 11. Specifically, if a small integration value is obtained, it means that the amount of received reflected light is small, and thus the sheets are in the loose state (there are few sheets). Conversely, if a large amount of reflected light is received, it means that the sheets are in the tight state (there are many sheets).

In the present embodiment, the operation of the main floor belt 11 and the sub-floor belt 12 is controlled according to signals output from the tightness detection sensor PF 11 and the height detection sensor 14. Note that the method of this control will be described below.

The take-out unit 20 is constituted by a negative pressure chamber 21, a take-out belt 22, a sub chamber 23, and an auxiliary chamber 24, for example.

The conveyance unit 30 is constituted by a take-in roller 31, a separation roller 32, a plurality of conveying rollers 33 and conveying belts 34 wrapped around the plurality of conveying rollers 33. Also, the conveying rollers 33 are controlled by a drive motor (not shown in the drawings) and a controller that controls the drive motor.

With the configuration described above, sheets P supplied on the main floor belt 11 in an upright state are conveyed to the take-out position of the take-out unit 20 by the main floor belt 11 and the sub-floor belt 12. The sheets P that have reached the take-out position are drawn, by suction, by the negative pressure chamber 21 provided at the take-out position, and attached, by suction, to the take-out belt 22, which has a plurality of through holes. The take-out belt 22 is rotated in the direction indicated by the arrow A in the drawing, and a single sheet at the front of the sheets P is taken out with this rotation, is taken into a conveyance path by the take-in roller 31 disposed downstream, and conveyed.

If overlapped feeding has occurred in which a plurality of overlapping sheets are taken in by the negative pressure chamber 21, the separation roller 32 rotates in reverse so as to convey the sheet at the front of the overlapping sheets into the conveying direction, while separating other sheets from the front sheet. A plurality of holes are provided on the outer periphery of the separation roller 32, which is held at a negative pressure, like the stated negative pressure chamber 21. Due to the negative pressure, the separation roller 32 causes sheets in the overlapped feeding to be attached thereto by suction, and conveys the sheets in the reverse direction. This method for preventing overlapped feeding by using the separation roller 32 has been conventionally performed, and thus a detailed description thereof will not be given here.

Figure 2:
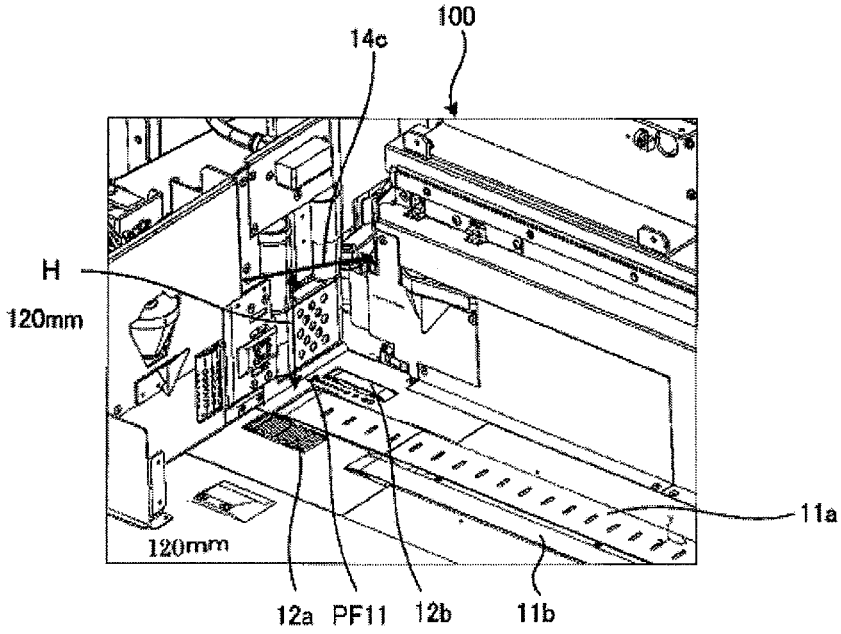
FIG. 2 is a perspective view illustrating the position of a height detection sensor of the sheet take-out device shown in FIG. 1.
Figure 3:
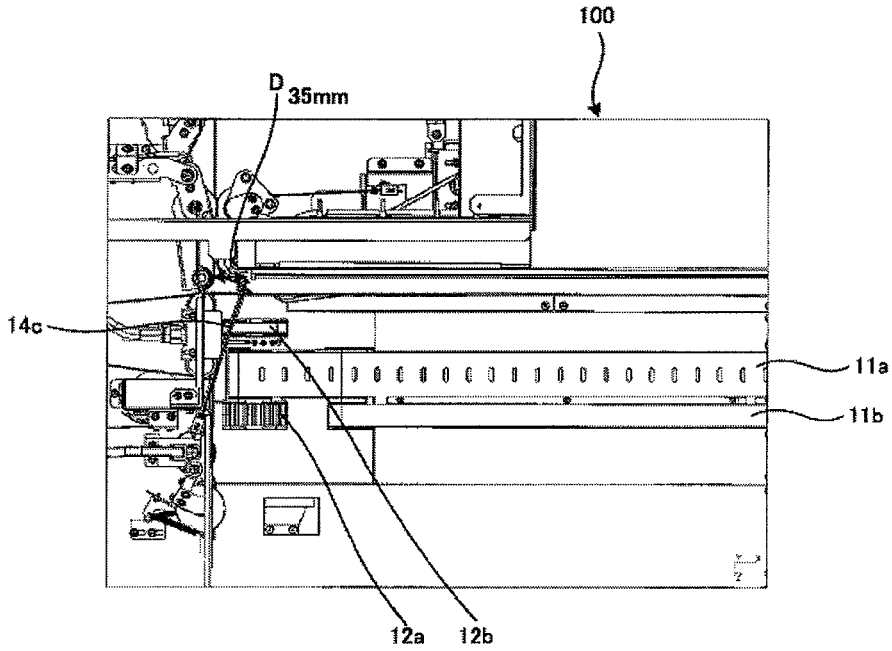
FIG. 3 is a plan view illustrating the detection position of the height detection sensor of the sheet take-out device shown in FIG. 2.

FIG. 2 is a perspective view illustrating the position of the height detection sensor 14 of the sheet take-out device 100 shown in FIG. 1. FIG. 3 is a plan view illustrating the detection position of the height detection sensor 14 of the sheet take-out device 100 shown in FIG. 2. FIGS. 2 and 3 illustrate the detection position of the height detection sensor 14 (this collectively refers to the light projector 14*a* and the light receiver 14*b*) that detects the height of the sheets P. The height detection sensor 14 is configured such that the light receiver 14*b* is disposed in a position where a height H from the main floor belt 11 (this collectively refers to the main floor belts 11*a* and 11*b*) is 120 mm, and a distance D from the take-out face (the surface of the take-in roller 31) is 35 mm, and a height detection sensor optical axis 14*c* is set such that the height of the sheets P present within this distance of 35 mm is detected. The height of a sheet P when the sheet is taken out by the take-out belt 22 and taken into the conveyance unit 30 by the take-in roller 31 is detected by the height detection sensor 14 disposed in the position described above.

Figure 4:
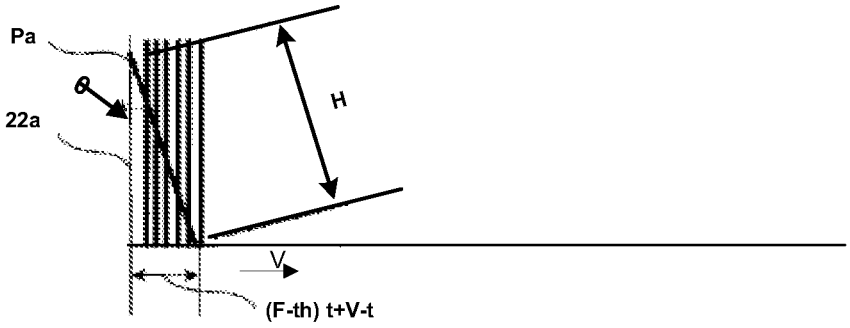
FIG. 4 is a diagram illustrating relation between the reversing amount and the reversing speed of a sub-floor belt according to Embodiment 1 of the present disclosure.

FIG. 4 is a diagram illustrating the relation between the reversing amount and the reversing speed of the sub-floor belt 12 (this collectively refers to the sub-floor belts 12*a* and 12*b*), and indicates the sheet height H and a sheet tilt angle θ when the sheet tilts.

Here, a case where sheets are not properly taken out will be described. Some sheets are taken out even when sheets are not properly taken out. The number of sheets that have been taken out is detected by a sensor PF 01 (see FIG. 1). When the number of sheets that have passed per unit time, which is detected by the sensor PF 01, is F (sheets/s), and an average thickness of the sheets taken out is th, then the sheets at the take-out unit are reduced at a rate of F·th (mm/s). Also, when the speed at which sheets are returned in the direction separating away from the take-out unit is V (mm/s), after t seconds, the sheet height H of the sheet at the take-out position is tilted by the sheet tilt angle θ indicted by Equation (1) indicated below.

In the case of the example shown in FIG. 4, considering a case where the last sheet Pa is left due to failure in properly taking out sheets, the surface of the take-out belt 22 at the take-out position is a take-out face 22*a*, and the sheets are taken out by the take-out belt 22 in order from the sheet at the front that is closest to the take-out face 22*a*. At this time, the upper portion of the last sheet Pa tilts toward the take-out face 22*a* as a result of the sheets in front thereof having been taken out, as shown in FIG. 4. The distance in t seconds is (F·th)·t.

Also, if the sub-floor belt 12 is rotated in reverse at this time, the reversing distance in t seconds is V·t, and thus the sheet tilt angle θ can be calculated by the following Equation (1), in which these are added.

$$\sin\theta=(F\cdot th+V)\cdot t/H \quad (1)$$

In the above expression,

F (sheets/s) indicates the take-out speed of sheets, which is measured by the sensor PF 01 in real-time, th (mm) indicates the average thickness of sheets, which can be changed according to the height of sheet, V (mm/s) indicates the sub-floor belt reversing speed, which can be changed according to the height of sheet, t (s) indicates the sub-floor belt reversing time, which can be changed according to the height of sheet, H (mm) indicates the sheet height, which is switched between two modes, and θ indicates the sheet tilt angle, which can be changed according to the height of sheet.

The take-out speed F (sheets/s) of sheets is the take-out speed of the sheets P that is obtained by the sensor PF 01 disposed near the take-in roller 31 shown in FIG. 1, and is measured in real-time.

The height H of sheets is classified into HH or HL depending on whether the sheet blocks the height detection sensor 14. For example, HH and HL are respectively set to 140 mm and 100 mm. Accordingly, a change according to the height of sheet is possible. th indicates an average thickness of sheets, and is set to 3 mm, for example. If the reversing speed V of the sub-floor belt is set to a predetermined value, and the sheet tilt angle θ is set to 15°, then the sub-floor belt reversing time t is calculated by the following Equation (2).

$$t=(H\cdot\sin\theta)/(F\cdot th+V) \quad (2)$$

An example of this is shown below.

When the sheet height H is 100 mm, the sheet tilt angle θ is 15°, the take-out speed F of sheets is 10 sheets/s, the sheet thickness th is 3 mm, and the sub-floor belt reversing speed V is 30 mm, Sub-floor belt reversing time t=(100·sin 15°)/(10×3 mm+30 mm)=0.83 s.

Specifically, it is possible to take out sheets without tilting of the sheets by changing the sub-floor belt reversing time t according to the sheet height H (HH and HL), and the take-out speed F obtained by the sensor PF 01. Accordingly, a change according to the height of sheet is possible.

In the present embodiment, although the number of sensors for detecting the sheet height H is one, it is also possible to dispose a plurality of sensors and thereby increase the number of classifications of the sheet height, and increase control modes.

Figure 5:
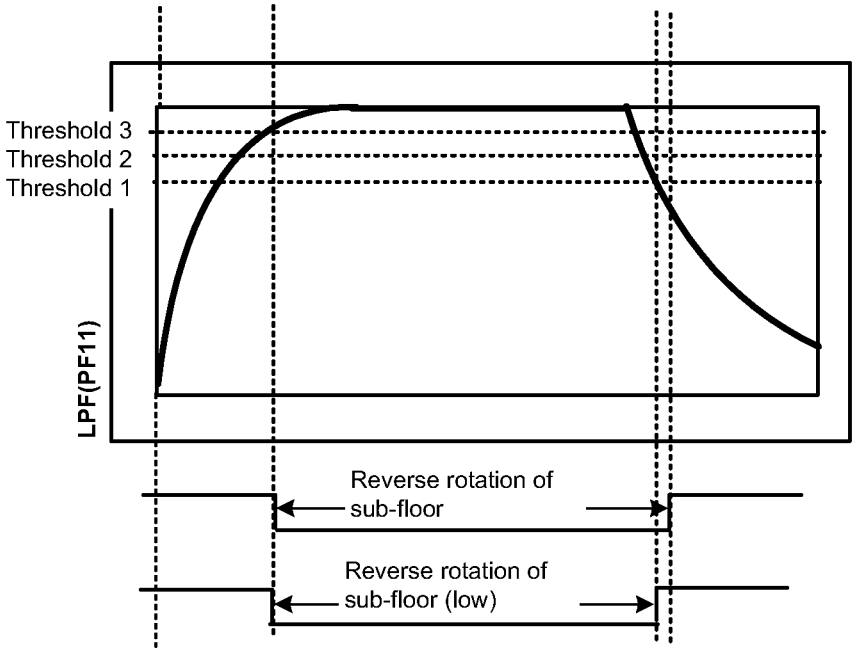
FIG. 5 is a graph illustrating the degree of tightness.

FIG. 5 is a graph illustrating the degree of tightness of the sheets placed on the take-out unit 20. This degree of tightness is detected by the tightness detection sensor PF 11. The tightness detection sensor PF 11 is configured by a reflection sensor, and if sheets are present within the detection range of the tightness detection sensor PF 11, it detects light reflected therefrom. FIG. 5 shows values obtained by integrating the amount of reflected light in the graph.

The output signal from the tightness detection sensor PF 11 is integrated in a normal take-out state (sub-floor normal state, regular rotation/stop). If the obtained integral value (hereinafter referred to as the degree of tightness) is less than a threshold 3, the normal take-out state is continued. If the degree of tightness exceeds the threshold 3 (excessive supply state), the sub-floor belt 12 is rotated in reverse. In the case of sheets whose sheet height H has been determined to be low through the height check performed by the height detection sensor 14, reverse rotation is stopped at a threshold 2 (the amount of reverse rotation is small). In the case of sheets whose sheet height H has been determined to be high through the height check performed by the height detection sensor 14, reverse rotation is continued until the degree of tightness drops to a threshold 1 (the amount of reverse rotation is large). The sub-floor belt 12 is reversed by an amount corresponding to the reversing amount of the sub-floor belt 12 described with reference to FIG. 4, and the degree of tightness obtained by the tightness detection sensor PF 11 is checked. There are other control methods as well such as a method in which the degree of tightness obtained by the tightness detection sensor PF 11 is constantly monitored while rotating the sub-floor belt 12 in reverse.

Figure 6:
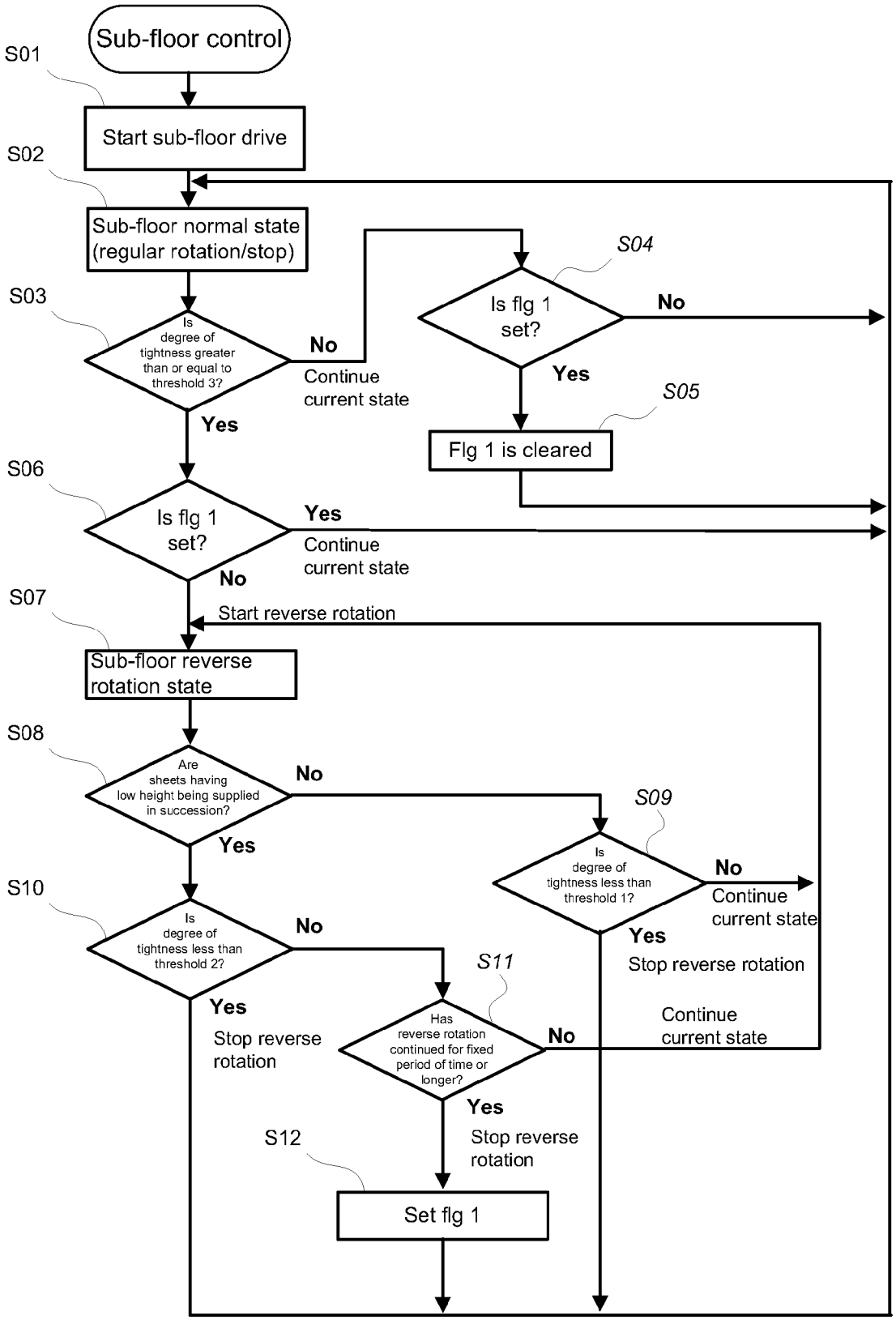
FIG. 6 is a flowchart illustrating a sub-floor drive control process.

FIG. 6 is an example flowchart of a sub-floor drive control process according to Embodiment 1 of the present disclosure. The sub-floor drive control refers to the control of the sub-floor belt 12 (this collectively refers to the sub-floor belts 12*a* and 12*b*), which will be hereinafter simply referred to as sub-floor control.

When driving of the sub-floor is started (step S01), the sub-floor reaches the normal take-out state, and the output signal from the tightness detection sensor PF 11 described above is integrated. It is determined whether the integral value (degree of tightness) is greater than or equal to the threshold 3 (third threshold). If the degree of tightness is less than the threshold 3 ("No" in step S03), it is determined whether a flag 1 (flg 1) is set (step S04).

If the result of this determination is that the flag 1 is not set ("No" in step S04), the procedure returns to step S02 and the normal take-out state is continued (step S02). Specifically, if the degree of tightness is less than the threshold 3 as described above, the excessive supply state has not been reached and thus the normal take-out state is continued. In this case, if the flag 1 described below is set, the flag 1 is cleared (step S05) and normal processing of the sub-floor belt 12 is performed (step S02), and if the flag 1 is not set ("No" in step S04), normal processing of the sub-floor belt 12 is performed (step S02).

If it is determined in step S03 that the degree of tightness is greater than or equal to the threshold 3 (excessive supply state) ("Yes" in step S03), and the flag 1 is set ("Yes" in step S06), the procedure returns to step S02, and the normal take-out state is continued until it is determined that the excessive supply state is continuing.

Conversely, if the degree of tightness is greater than or equal to the threshold 3 (excessive supply state) and the flag 1 is not set ("No" in step S06), the sub-floor belt 12 is driven to rotate in reverse (step S07).

Next, as a result of the detection of the sheet height performed by the height detection sensor 14, if sheets having a low height are being supplied in succession ("Yes" in step S08) and the degree of tightness is less than the threshold 2 (second threshold) ("Yes" in step S10), the reverse rotation is stopped.

On the other hand, when sheets having a low height are being supplied in succession ("Yes" in step S08) and the degree of tightness is greater than or equal to the threshold 2 (second threshold) ("No" in step S10), and the operation is continued for a predetermined period of time or longer in such a state ("Yes" in step S11), then the flag 1 is set (step S12). That is to say, if the degree of tightness does not drop to a value less than the threshold 2 ("No" in step S10) and such a state has continued for a predetermined period of time ("Yes" in step S11), even though the sub-floor belt 12 has been driven to rotate in reverse for a predetermined period of time because sheets having a low height are being taken out in succession and the degree of tightness of the sheets has reached a value greater than or equal to the threshold 3, the flag 1 is set (step S12) and the sub-floor belt 12 is returned to the normal take-out state (step S02).

That is to say, if the degree of tightness is greater than or equal to the threshold 3 (excessive supply state) and thus the sub-floor belt 12 has been driven to rotate in reverse, but a state in which the degree of tightness does not drop to a value less than the threshold 2 has continued for a fixed period of time, the flag 1 is set since an abnormal state may have occurred (step S12) and the taking out of sheets is continued.

Note that even during the reverse rotation driving, if it is determined as a result of detection of the height of sheets by the height detection sensor 14 that sheets having a low height are not being supplied in succession ("No" in step S08) and the degree of tightness is less than a threshold 1 ("Yes" in step S09), the state has been improved to a loose state in which the degree of tightness is less than the threshold 1. Thus, the reverse rotation of the sub-floor belt 12 is stopped, and the sub-floor belt 12 is returned to the normal take-out state.

Since the state has been improved in this state, if it is determined in step S303 that the degree of tightness is less than the threshold 3 ("No" in step S03), the flag 1 that has been set is cleared (step S05).

Conversely, if the degree of tightness does not drop to a value that is less than the threshold 2 ("No" in step S10) and also that state has not continued for a predetermined period of time ("No " in step S11), the sub-floor belt 12 is kept in the reverse rotation state ("No" in step S11).

Also, if sheets having a low height are not being supplied in succession in step S08 ("No" in step S08) and also the degree of tightness is not less than the threshold 1 ("No" in step S09), the sub-floor belt 12 is kept in the reverse rotation state.

Conversely, if the degree of tightness is less than the threshold 1 in step S09 ("Yes" in step S09), the excessive supply state of sheets having a low height is not given, and thus the normal take-out state is continued (step S02).

As described above, with the present embodiment, it is possible to improve reduction in the processing efficiency due to failure in properly taking out sheets having a low height by controlling the reverse rotation amount of the sub-floor belt according to the degree of tightness and the height information of sheets supplied to the take-out unit.

DESCRIPTION OF REFERENCE NUMERALS

100 sheet take-out device
10 supply unit
P sheet
11 (11*a*, 11*b*) main floor belt
12 (12*a*, 12*b*) sub-floor belt
PF01 sensor
PF11 tightness detection sensor
14 height detection sensor
20 take-out unit
22 take-out belt
30 conveyance unit
31 take-in roller
32 separation roller
33 conveying roller
34 conveying belt

What is claimed is:

1. A sheet take-out device comprising:

a main floor belt that conveys sheets that are placed in an upright state in a direction intersecting a conveying direction to a take-out portion;

a take-out unit that takes out the sheets conveyed by the main floor belt one by one in order from the frontmost sheet; and a conveyance unit that conveys the sheets taken out by the take-out unit, wherein a failure in properly taking out sheets is improved by comprising:

a sub-floor belt that is disposed at a location on the same plane as a conveyance face of the main floor belt and opposing a leading end in the conveying direction of the main floor belt, and that is capable of reverse conveyance, in which sheets are conveyed in a direction opposite to the conveying direction of the main floor belt;

a tightness detection unit that detects the tightness of the sheets immediately prior to being taken out by the take-out unit;

a height detection unit that detects the height of the sheets immediately prior to being taking out by the take-out unit; and a sub-floor control unit that sets a time for the reverse conveyance performed by the sub-floor belt according to a result of detection performed by the tightness detection unit and the sheet height obtained by the height detection unit.

2. The sheet take-out device according to claim 1, wherein the tightness detection unit comprises:

a reflection sensor that detects an end portion of the sheets placed in the upright state; and a tightness degree calculation unit that integrates a reflection sensor output that has been output from the reflection sensor, and calculates a degree of tightness, the sub-floor control unit comprises a threshold setting unit that sets a first threshold, a second threshold and a third threshold as thresholds with which the degree of tightness calculated by the tightness degree calculation unit is compared, the values of the first threshold, the second threshold, and the third threshold increasing in this order, and in a case where the sub-floor belt is set to a reverse state by rotating the sub-floor belt in reverse in an excessive supply state in which the degree of tightness calculated by the tightness detection unit is greater than or equal to the third threshold, if sheets whose height detected by the height detection unit is less than a predetermined height are being supplied in succession and the degree of tightness of the sheets is less than the second threshold, the sub-floor control unit stops reverse rotation of the sub-floor belt and sets the sub-floor belt to a normal operation state.

3. The sheet take-out device according to claim 1 or 2, wherein in a case where the sub-floor belt is set to a reverse state by rotating the sub-floor belt in reverse in an excessive supply state in which the degree of tightness calculated by the tightness detection unit is greater than or equal to a third threshold, if sheets whose height is less than a predetermined height are being supplied in succession and a state in which the degree of tightness of the sheets is greater than or equal to a second threshold has continued for a predetermined period of time, the sub-floor control unit stops reverse rotation of the sub-floor belt and sets a flag indicating an abnormal state.

4. The sheet take-out device according to claim 1, wherein in a case where the sub-floor belt is set to a reverse state by rotating the sub-floor belt in reverse in an excessive supply state in which the degree of tightness calculated by the tightness detection unit is greater than or equal to a third threshold, if the height of sheets is higher than a predetermined height and the degree of tightness of the sheets is less than a first threshold, the sub-floor control unit stops reverse rotation of the sub-floor belt and sets the sub-floor belt to a normal operation state.

5. The sheet take-out device according to claim 1, wherein in a case where the sub-floor belt is set to a reverse state by rotating the sub-floor belt in reverse in an excessive supply state in which the degree of tightness calculated by the tightness detection unit is greater than or equal to a third threshold, if the height of sheets is higher than a predetermined height and the degree of tightness of the sheets is greater than or equal to a first threshold, or if sheets whose height is less than a predetermined height are being supplied in succession and a state in which the degree of tightness of the sheets is greater than or equal to a second threshold has not continued for a predetermined period of time, the sub-floor control unit keeps the sub-floor belt in the reverse rotation state.

* * * * *